United States Patent [19]

Freudenthal

[11] 4,100,973

[45] Jul. 18, 1978

[54] SIDE LOAD PROTECTION ARRANGEMENT FOR ROTATING EQUIPMENT

[75] Inventor: Frank D. Freudenthal, Saint Joseph, Mo.

[73] Assignee: Altec Industries, Inc., Saint Joseph, Mo.

[21] Appl. No.: 673,600

[22] Filed: Apr. 5, 1976

[51] Int. Cl.[2] ..... E21C 5/00

[52] U.S. Cl. ..... 173/44; 188/170; 192/3 N; 212/39 B; 212/66

[58] Field of Search ..... 74/411.5; 173/43, 44; 188/170; 192/3 N; 212/35 R, 39 R, 39 B, 39 DB, 66, 67, 68, 69

[56] References Cited

U.S. PATENT DOCUMENTS

| | | | |
|---|---|---|---|
| 3,315,820 | 4/1967 | Stauffer | 212/35 R |
| 3,396,852 | 8/1968 | Balogm et al. | 212/35 R |
| 3,499,543 | 3/1970 | Updegrave | 212/66 |
| 3,690,387 | 9/1972 | Dixon | 212/66 X |

FOREIGN PATENT DOCUMENTS

| | | | |
|---|---|---|---|
| 2,261,216 | 9/1975 | France | 212/39 R |
| 2,318,151 | 11/1974 | Fed. Rep. of Germany | 212/39 B |

*Primary Examiner*—Lawrence J. Staab
*Attorney, Agent, or Firm*—Lowe, Kokjer, Kircher, Wharton & Bowman

[57] ABSTRACT

A brake release arrangement by which damage which otherwise would result from the application of excessive side loading to rotating equipment such as the boom of a digger derrick or crane is avoided. The drive system for rotating the boom includes a hydraulic motor, a non self-locking speed reducer and a spring applied, hydraulically releasable brake. Included in the brake release mechanism is a line which taps into the hydraulic line leading to the power equipment mounted on the boom and whose operation develops side loads. An adjustable pressure reducing valve in the tap line provides a fluid output at a reselected pressure to a small chamber in the brake housing. The pressurized fluid in the chamber acts on a piston which, when the side loading on the boom is great enough to cause damage, partially relaxes the brake force thus to permit slippage and back drive of the speed reducer and motor thereby to relieve the side load torque.

7 Claims, 4 Drawing Figures

SIDE LOAD PROTECTION ARRANGEMENT FOR ROTATING EQUIPMENT

BACKGROUND AND SUMMARY OF THE INVENTION

This invention relates in general to a side load protection system for rotating equipment such as digger derricks and cranes.

Digger derricks, cranes, and other types of rotating equipment which are mounted to utility vehicles typically include a rotating turret from which a boom extends. The turret or boom is usually equipped with a winch having a line extending over a sheave on the outboard end of the boom. In the case of a digger derrick, an earth auger or earth anchor driving tool is mounted on the boom and provided with a motor and speed reducer. The boom is connected to the turret for up and down pivotal movement and is usually extensible and retractable so that its outboard end may be universally positioned to perform various digging or hoisting operations.

Typically, the rotation system for this type of equipment includes a hydraulic motor, a speed reducer with a pinion gear on the output shaft, and a large stationary bull gear on the frame to which the turret is rotatably mounted. A motor drives the pinion gear through the speed reducer, and this rotates the pinion around the bull gear to thereby rotate the turret and the boom. The speed reducer is often a self-locking type which may be driven from only the motor side and not from the opposite or pinion side.

A self-locking speed reducer has an inherent tendency to "step" when the boom is rotated down a grade. The "stepping" is caused by the self-locking or one-way nature of the speed reducer as it stops the boom rotation until the motor catches up with the boom and then allows the boom to start downhill again such that it runs ahead of the motor momentarily until stopped by the speed reducer, whereupon the stepping action is repeated.

In order to eliminate this objectionable stepping action and obtain a smooth boom rotation even when rotating down a grade, the recent trend has been to employ a non self-locking speed reducer mechanism which may be driven from either side; i.e., from the motor side as intended and also from the boom or pinion side in back driving fashion. With this type of speed reducer, the drive linkage requires a brake in order to stop the load when the boom rotation is stopped, and to normally prevent back driving under the influence of the load when the boom is not being rotated. The brake must be powerful in order to be able to quickly stop the boom when it is being rotated down a grade with substantial momentum. Also, the brake must be able to easily release when the boom is set into rotation by the drive motor.

Typically, the brake is a disc type brake which is spring biased such that it is normally engaged to prevent rotation of the boom. When the hydraulic rotation motor is activated to begin rotating the boom, hydraulic fluid is forced under pressure against a piston which releases the brake and thereby permits the boom to be driven. The primary problem with this type of brake arrangement is that it offers no protection against excessive side loading of the machine.

Excessive side loading can be applied to the boom when the winch is used to pull a heavy load in from the side of the boom rather than positioning the outboard end of the boom directly above the load. It can also be applied if an auger type digger "corkscrews" into the ground due to the application of excessive pressure in driving the auger at an angle from vertical. In addition, destructive side loading can result from improper installation of a screw type earth anchor which is driven into the ground by a special tool. These earth anchors screw themselves into the ground at an inclined angle under the influence of the driving tool. It is necessary for the digger operator to lower and swing the boom to the side as the earth anchor is being driven so that the boom will generally follow the path of the earth anchor. However, if he forgets or otherwise fails to do so, the earth anchor will tend to pull the boom to one side and thus exert considerable side loading on the machine.

The result of excessive side loading is often destruction of the boom, turret, or rotation deive mechanism. The boom is pulled in the direction of the load, and in the case of a non self-locking speed reducer this tendency is strongly resisted by the brake. The brake is powerful enough to permit the boom from back driving toward the load, and consequently, the boom bends, the gears in the drive system are stripped, or the turret is severely damaged.

It is an object of the present invention to provide, in a rotation drive system, a brake release arrangement which, whenever the external side loading on the equipment exceeds a preselected level, partially relaxes the brake force to permit slippage.

Another object of the invention is to provide a brake release arrangement of the character described which does not interfere with normal operation of the brake or drive system.

Yet another object of the invention is to provide a brake release arrangement of the character described that is adjustable as to the extent to which the brake releases when excessive side loading occurs. This adjustability feature permits setting of the brake release at a level where the brake slips just prior to the load level at which damage to the machine would occur, so that the machine is able to handle normal loads without slippage of the brake. Also, compensation is made for wear and other variations in the brake and other components of the drive linkage.

A further object of the invention is to provide a brake release arrangement of the character described that operates hydraulically in order to take advantage of the existing hydraulic system of the machine.

An additional object of the invention is to provide a brake release arrangement of the character described that operates only when the equipment that can cause side loading is operating. Since the brake release takes hydraulic fluid from the supply line to the digger and winch motors, it operates only when needed; i.e., when the digger or winch is operating to possibly overload the machine.

Still another object of the invention is to provide a brake release of the character described which is simple, reliable, and economical.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith and in which like reference numerals are used to indicate like parts in the various views.

Figures 1, 4:
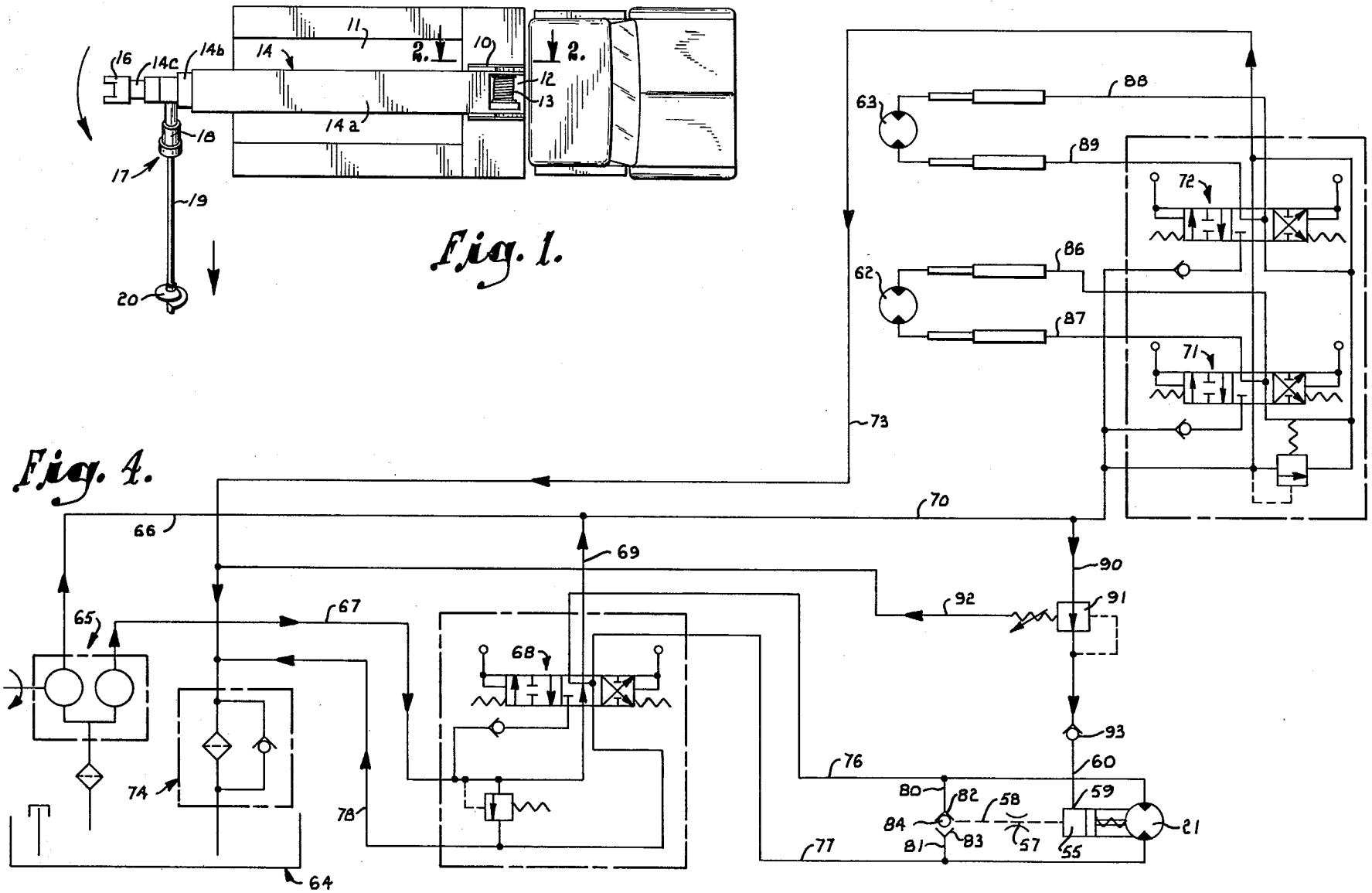
FIG. 1 is a top plan view illustrating diagrammatically a typical digger derrick implement with which the subject invention is adapted to be employed.
FIG. 4 is a schematic of the hydraulic system for the implement.
Figures 2, 3:
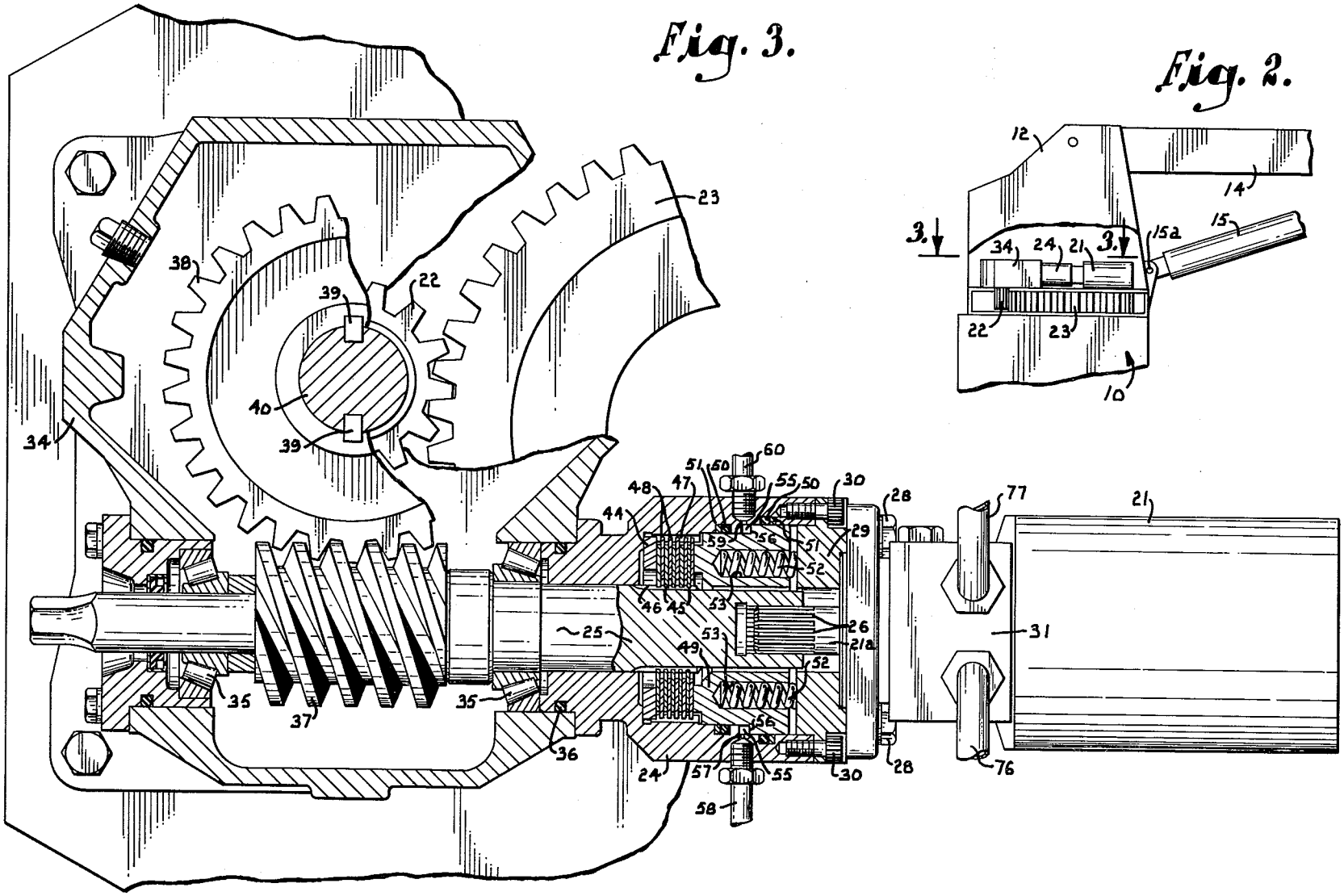
FIG. 2 is a fragmentary side elevational view on an enlarged scale taken generally along line 2—2 of FIG. 1 in the direction of the arrows, with a portion of the turret broken away to illustrate the internal details.
FIG. 3 is a fragmentary cross sectional view on an enlarged scale taken generally along line 3—3 of FIG. 2 in the direction of the arrows and illustrating the rotation drive mechanism which rotates the boom, with portions broken away for illustrative purposes.

Referring to the drawings in detail, FIGS. 1 and 2 illustrate a conventional truck mounted digger derrick machine of the type with which the present invention is adapted for use. A frame structure 10 mounted in a truck bed 11 rotatively supports a turret 12 which is equipped with a hydraulically powered winch 13. Extending outwardly from turret 12 is an elongate boom 14 which rotates with the turret. Boom 14 is able to pivot up and down relative to turret 12 and is powered in such movement by a hydraulic cylinder 15 (FIG. 2) which is pivoted to the turret at 15*a* at one end and to the boom at its opposite end (not shown). The boom usually includes a plurality of sections 14*a*, 14*b*, and 14*c* which extend and retract relative to one another in telescopic fashion in order to vary the boom length. A sheave 16 is carried on the outboard end of boom 14 to receive the cable of winch 13 during operation of the winch.

A driving tool 17 is mounted on the intermediate section 14*b* of boom 14. A power unit 18 of the driving tool rotates a shaft 19 which is used to install an earth anchor 20 in the ground. A digging tool in the form of a conventional earth auger (not shown) may be interchanged with the earth anchor 20 and used to dig holes in the ground.

The earth anchor 20 is typically screwed into the ground at an inclined angle from vertical, as shown in FIG. 1. An external side load is thereby applied to boom 14 in the direction of the arrow unless the boom operator lowers and rotates the boom as the earth anchor is being installed. If the auger (not shown) is driven into the ground at an angle, it can "corkscrew" and cause side loading of the boom in much the same manner as the earth anchor 20. Also, when a heavy load is pulled sidewardly by the winch 13, excessive side loading of the boom can occur. The force of the side load tends to pull the boom in the rotative direction indicated by the arrow in FIG. 1, and severe damage to the equipment can occur if the boom is not able to rotate in back driven fashion under the influence of excessive side loads. The present invention is concerned with protecting against damage from such side loading, as will be explained in more detail.

The boom 14 and turret 12 are driven rotatively by a hydraulic motor 21 which is mounted to the turret, as best shown in FIG. 2. Motor 21 drives a pinion gear 22 through a speed reducer arrangement, and pinion 22 mates with a large stationary bull gear 23 mounted to the frame 10 in order to rotate turret 12 and boom 14 relative to the frame.

Referring now to FIG. 3 in particular, the rotation drive mechanism and speed reducer are illustrated in detail. Motor 21 drives an output shaft 21*a* which extends into a brake housing 24, within which it connects to another and larger shaft 25 by means of splines 26. A motor mounting flange 27 is bolted at 28 to a cover plate 29 which is in turn screwed at 30 to the brake housing 24. A valve housing 31 houses a shuttle valve arrangement that will be described hereinafter. Valve housing 31 is mounted on the motor 21.

Shaft 25 extends into a gear box 34 and is supported for rotation therein by bearings 35. A seal ring 36 is fit between brake housing 24 and gear box 34. Within the gear box 34, shaft 25 carries a worm gear 37 which mates with and drives a larger worm wheel 38. Gear 38 is keyed at 39 to a shaft 40 which projects below gear box 34. On its lower end, shaft 40 carries the pinion gear 22 which mates with the large bull gear 23 that is mounted to the frame 10, as previously indicated. The gear box 34 is mounted to turret 12 so that rotation of pinion 22 drives it around the periphery of bull gear 23 and thus rotates turret 12 and boom 14.

The worm gear 37 and wheel 38 serve as a speed reducer for the drive linkage of motor 21. The worm gear and wheel are of the non self-locking type which may be driven forwardly in the intended manner by motor 21 but which may also be back driven from the turret or pinion side when boom 14 is subjected to external forces that tend to rotate the boom. As an alternative to the worm gear set, the speed reducer may be a combination of planetary gears, spur gears, or any other speed reducing arrangement which is of the non self-locking type.

The brake housing 24 contains a disc type brake mechanism that is normally engaged to prevent the drive linkage from being driven either forwardly or backwardly. An annular plate 44 is mounted to the brake housing against an interior wall thereof. A series of annularly shaped brake discs 45 having high friction surfaces are mounted to shaft 25 for rotation therewith by splines 46. The splines 46 allow discs 45 to shift toward and away from one another. Splines 47 mount a second series of brake discs 48 to brake housing 24, allowing the discs 48 also to shift toward and away from one another and relative to discs 45. Discs 45 and 48 are sandwiched together in alternating fashion so that their high friction surfaces oppose one another to apply a braking force when the discs are pressed together.

A piston 49 which is fitted around shaft 25 serves to engage and disengage the brake. Piston 49 is able to slide within brake housing 24 in a direction longitudinally of shaft 25. Seal rings 50 with associated backup rings 51 form seals between the brake housing and piston. A plurality of strong compression springs 52 are fitted within cavities 53, which are formed at equally spaced locations around piston 49. One end of each spring 52 bears against the flat surface of cover plate 29, which is normally spaced slightly from piston 49. Springs 52 continuously urge piston 49 to the left as viewed in FIG. 3, and the piston is thus yieldably biased in a manner to press discs 45 and 48 against one another, thereby engaging the brake and preventing rotation of shaft 25.

The brake is released hydraulically. A small annular fluid chamber 55 is formed within brake housing 24 at a location adjacent to a flat shoulder 56 which is presented by piston 49. Chamber 55 is located between seal rings 50 to prevent fluid leakage. Shoulder 56 faces to the left (FIG. 3), and pressurized fluid within chamber 55 therefore acts against the shoulder to force piston 49 to the right against the bias of springs 52. This releases the frictional connection of the brake discs 45 and 48 to disengage the brake and permit shaft 25 to rotate.

The brake is normally released through application of hydraulic fluid pressure to the chamber 55 through a metering orifice 57 and hydraulic line 58. A description of the hydraulic circuitry is provided at a later point herein.

As thus far described, the drive and brake mechanism is conventional.

In a unit incorporating my invention, second port 59 to chamber 55 is provided in order to supply hydraulic pressure thereto for partial release of the brake under conditions of excessive side loading of boom 14, as will hereinafter be explained in more detail. Port 59 is purposely made much larger than the orifice 57 of the first port. A fluid line 60 connects with port 59 to deliver fluid thereto.

FIG. 4 illustrates schematically the hydraulic system which controls the operation of the rotation motor 21, the hydraulic winch motor 62 and the hydraulic digger motor 63. The hydraulics for operating outriggers, boom elevation, boom extension and retraction, and other functions of the machine are eliminated from the schematic of FIG. 3 for purposes of simplicity.

The hydraulic system includes a fluid reservoir 64 from which oil is pumped by a double pump 65. The large side of pump 65 delivers oil through a fluid line 66, and the small side of the pump delivers oil to a line 67 that leads to a directional control valve 68 for the rotation motor 21. With valve 68 in the neutral position shown, the hydraulic fluid passes through the valve and through a power beyond port (not shown) into a line 69 which joins line 66 to form a common supply line 70 for the winch control valve 71 and digger control valve 72. The oil that passes through the winch and digger control valves flows back to reservoir 64 through a return line 73 in which a filter 74 is disposed. Since the rotation motor 21 requires much less fluid than the winch or digger motor, the double pump 65 is preferred because it permits most of the fluid to bypass valve 68. However, a single pump that would pump all of the fluid through valve 68 may be employed instead.

When boom 14 is to be rotated, valve 68 is moved in one direction or the other to direct the incoming fluid out of the valve into either line 76 or 77, depending upon the desired direction of boom rotation. Movement of valve 68 to the right of neutral directs the oil into line 76, through motor 21 to drive it in one direction, through line 77, back through valve 68, and back to reservoir 64 through line 78. Conversely, if valve 68 is shifted to the left of neutral, the incoming oil passes through motor 21 in the opposite direction, from line 77 to line 76 to rotate the boom in the opposite direction.

A pair of short fluid lines 80 and 81 tap into the respective lines 76 and 77 and lead to valve seats 82 and 83. A shuttle ball valve 84 moves between seats 82 and 83 and closes off fluid flow through whichever valve seat it is disposed on. Each seat 82 and 83 connects with the fluid line 58 that leads to chamber 55 through the orifice 57. With valve 68 positioned to direct fluid through motor 21 from line 76, the pressure in line 76 is picked off in line 80 to push valve 84 against seat 83, and chamber 55 receives pressurized fluid through line 80, seat 82, line 58, and orifice 57. When fluid is flowing through motor 21 from line 77, the pressure in line 81 moves ball 84 against seat 82 so that the fluid flow is through line 81, seat 83, line 58, and orifice 57 into chamber 55. Accordingly, whenever valve 68 is positioned to activate motor 21 in either direction, pressurized fluid is directed into chamber 55 in order to disengage the brake.

The winch motor 62 is activated by shifting valve 71 from the neutral position. Lines 86 and 87 lead from valve 71 to motor 62. Depending upon the position of valve 71 from neutral, the incoming fluid flows through motor 62 in a direction from line 86 to line 87 or from line 87 to line 86. Similarly, lines 88 and 89 lead from valve 72 to the digger motor 63 to direct fluid through the digger motor. Again, the direction of flow through the digger motor depends upon the direction that valve 72 is moved from neutral.

In the arrangement incorporating the present invention, a fluid line 90 is tapped into the line 70 that leads to the winch and digger controls. Line 90 connects with line 70 downstream of the junction between lines 66 and 69 but upstream of the winch and digger valves 71 and 72. A pressure reducing valve 91 is disposed in line 90. Valve 91 operates conventionally to receive on its input side a variable pressure (depending on the pressure in line 90 which in turn depends on the pressure in line 70), which is reduced to a predetermined constant pressure on the output side of the valve. Valve 91 is of a well known adjustable type so that its output pressure may be varied as desired by making the proper adjustment. A line 92 for bleeding off fluid extends from valve 91 to connection with the return line 73.

A check valve 93 is disposed in line 90 downstream of the pressure reducing valve 91 in order to prevent back flow of oil. Downstream of check valve 93, line 90 merges with the line 60 that leads to the nonorificed inlet port 59 of chamber 55.

In operation, boom 14 is rotated by shifting valve 68 from the neutral position. The direction that the motor shaft **21*a* is driven depends upon the direction of oil flow through motor 21 in lines 76 and 77, which in turn depends upon the direction that valve 68 is shifted. In any event, immediately upon shifting of valve 68 from neutral, oil is able to flow past the shuttle ball valve 84 through line 80 or 81, into line 58, and through orifice 57 into the fluid chamber 55. The fluid pressure in chamber 55 forces piston 49 away from the brake discs 45 and 48 and thereby completely disengages the brake to permit shaft 25 to be rotated by motor 21. Consequently, whenever motor 21** is activated, the brake is completely released so that it will not interfere with the rotation drive mechanism.

The activated rotation motor 21 drives shaft **21*a* which drives the worm shaft 25 and the worm gears 37 and 38. Pinion 22 is thus rotated around the periphery of the large bull gear 23 to rotate turret 12 and boom 14**.

Motor 21 is deactivated to stop the boom rotation by shifting valve 68 back to neutral. This cuts off the flow to motor 21 and causes the fluid pressure in chamber 55 to bleed off through line 58. Springs 52 then move piston 49 to the left (FIG. 3) which firmly presses discs 45 and 48 together to fully apply the brake. The brake is thus automatically engaged immediately on deactivation of motor 21. The small size of orifice 57 prevents rapid fluid flow in and out of chamber 55 to assure gradual application and release of the brake, thereby eliminating sudden starts and stops of the rotation drive system.

The winch motor 62 and digger motor 63 are operated by their respective control valves 71 and 72 which are shifted from the neutral position to activate the winch or digger. When this equipment is operated at a power level great enough to cause side loading of boom 14 that could possibly damage the machine, the hydraulic pressure in line 70 builds up substantially. The pressure in line 70 is picked off and transmitted via line 90 to the pressure reducing valve 91. The variable pressure input fluid to valve 91 is reduced to a constant pressure on the output side of the valve. The constant pressure output fluid from valve 91 flows through the check valve 93 and into line 60, from where it enters chamber 55 through the nonorificed inlet port 59. Due to the large size of port 59 relative to orifice 57, the oil flows out of chamber 55 through the orifice at a much slower rate than it enters through port 59, so that the pressure builds up in chamber 55. The fluid acting against piston 49 is set at a pressure to cause at least partial release of the brake so that discs 45 and 48 are able to slip relative to one another when powerful side loads are exerted on boom 14 tending to back drive the rotation drive mechanism. Consequently, the brake slips whenever the side loading on the boom is great enough to cause damage to the machine.

Since the pressure reducing valve 91 is adjustable, the pressure of the fluid in chamber 55 may be set at any desired level. It is not desirable for the brake to fully release or to release to a point where the rotation system is able to "free wheel." Therefore, valve 91 is preferably adjusted to a setting wherein the fluid pressure only partially releases the brake so that the brake discs 45 and 48 slip only when the external side loading approaches a level that could cause damage. The boom is able to function normally without slipping when handling normal loads with the pressure reducing valve 91 adjusted appropriately. Usually, the setting of valve 91 will be adjusted with the passage of time in order to compensate for wear on the brake discs and drive components.

From the foregoing, it will be seen that this invention is one well adapted to attain all of the ends and objects hereinabove set forth together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A rotation drive mechanism for driving a rotatably supported body which is subject to being side loaded in a manner tending to rotate the body, said drive mechanism comprising:

a motor having an activated state and a deactivated state;

drive linkage coupling said motor with said body to drivingly rotate the latter;

a brake mechanism associated with said drive linkage, said brake mechanism being yieldably biased into engagement to prevent rotation of the body when said motor is deactivated and operable to release from engagement to permit rotation of said body when said motor is activated; and a brake release means operable when said motor is in a deactivated state to at least partially disengage said brake mechanism to allow back driving of the body when the side load to which said body is subjected exceeds a pre-selected level, said brake release means comprising:

a fluid chamber for receiving pressurized fluid to act on said brake mechanism to partially release same;

a fluid supply line leading to said chamber for delivering pressurized fluid thereto through an inlet port;

means responsive to side loads on said body for forcing pressurized fluid through said supply line and into said chamber with said motor deactivated; and said fluid chamber having an outlet port, said outlet port being an orifice substantially smaller in size than said inlet port.

2. A rotation drive mechanism for driving a rotatably supported body which is subject to being side loaded in a manner tending to rotate the body, said drive mechanism comprising:

a motor having an activated state and a deactivated state;

drive linkage coupling said motor with said body to drivingly rotate the latter;

a brake mechanism associated with said drive linkage, said brake mechanism being yieldably biased into engagement to prevent rotation of the body when said motor is deactivated and operable to release from engagement to permit rotation of said body when said motor is activated; and a brake release means operable when said motor is in a deactivated state to at least partially disengage said brake mechanism to allow back driving of the body when the side load to which said body is subjected exceeds a pre-selected level, said brake release means comprising:

a fluid chamber for receiving pressurized fluid to act on said brake mechanism to partially release same;

a fluid supply line leading to said chamber for delivering pressurized fluid thereto through an inlet port;

means responsive to side loads on said body for forcing pressurized fluid through said supply line and into said chamber with said motor deactivated; and means for adjusting the pressure of the fluid delivered to said fluid chamber.

3. A rotation drive mechanism for driving a rotatably supported body which is subject to being side loaded in a manner tending to rotate the body, said drive mechanism comprising:

a motor having an activated state and a deactivated state;

drive linkage coupling said motor with said body to drivingly rotate the latter;

a brake mechanism associated with said drive linkage, said brake mechanism being yieldably biased into engagement to prevent rotation of the body when said motor is deactivated and operable to release from engagement to permit rotation of said body when said motor is activated; and a brake release means operable when said motor is in a deactivated state to at least partially disengage said brake mechanism to allow back driving of the body when the side load to which said body is subjected exceeds a pre-selected level, said brake release means comprising:

a fluid chamber for receiving pressurized fluid to act on said brake mechanism to partially release same;

a fluid supply line leading to said chamber for delivering pressurized fluid thereto through an inlet port;

means responsive to side loads on said body for forcing pressurized fluid through said supply line and into said chamber with said motor deactivated; and a pressure reducing valve disposed in said fluid supply line, said pressure reducing valve having an input side for receiving fluid at variable pressure and an output side delivering fluid to said chamber at a pre-selected pressure.

4. The invention of claim 3, including a check valve in said fluid supply line between said pressure reducing valve and said chamber.

5. The invention of claim 3, including means associated with said pressure reducing valve for adjusting the pressure on the output side thereof.

6. In combination with a rotatably supported body, a side load applying tool on said body, a hydraulic motor for powering said tool, a fluid inlet line to said motor for delivering pressurized fluid thereto, a power driven linkage for rotatively driving said body, and a brake mechanism for said linkage yieldably biased into engagement to prevent rotation of said body and hydraulically releasable to permit rotation of the body, brake release means comprising:

a fluid supply line communicating with said inlet line to receive pressurized hydraulic fluid therefrom when said tool is being powered by said hydraulic motor;

a pressure reducing valve having an input side disposed to receive hydraulic fluid from said fluid supply line at variable pressure, said pressure reducing valve having an output side delivering fluid at a substantially constant pressure; and means directing fluid from the output side of said pressure reducing valve to said brake mechanism to at least partially release same.

7. The invention set forth in claim 6, including means for adjusting the fluid pressure on the output side of said pressure reducing valve.

* * * * *